United States Patent [19]

Gach

[11] Patent Number: 4,643,321

[45] Date of Patent: Feb. 17, 1987

[54] TAMPER INDICATING BAND FOR THREADED CAP

[75] Inventor: Peter P. Gach, Evansville, Ind.

[73] Assignee: Sunbeam Plastics Corporation, Evansville, Ind.

[21] Appl. No.: 783,737

[22] Filed: Oct. 3, 1985

[51] Int. Cl.[4] ..... B65D 41/34

[52] U.S. Cl. ..... 215/252; 53/490

[58] Field of Search ..... 215/252; 53/490

[56] References Cited

U.S. PATENT DOCUMENTS

| | | | |
|---|---|---|---|
| 3,455,478 | 7/1969 | Fields et al. | 215/252 |
| 4,457,438 | 7/1984 | Varlet et al. | 215/252 |
| 4,493,427 | 1/1985 | Wolkonsky | 215/252 |
| 4,511,053 | 4/1985 | Brandes et al. | 215/252 |
| 4,550,844 | 11/1985 | Lininger | 215/252 |
| 4,576,298 | 3/1986 | Boik | 215/252 |

*Primary Examiner*—Donald F. Norton

*Attorney, Agent, or Firm*—Irvin L. Groh

[57] ABSTRACT

A tamper indicating band which can be fitted over the scuff band of a conventional screw cap. The band has a larger diameter upper ring with a retaining bead which snaps over the scuff band and a smaller diameter lower ring which has a bead which snaps over a container bead. Unthreading the cap from the originally packaged container fractures frangible webs joining the bead's upper and lower rings. Evidence of initial opening or tampering remains by retention of the lower ring around the container neck.

19 Claims, 12 Drawing Figures

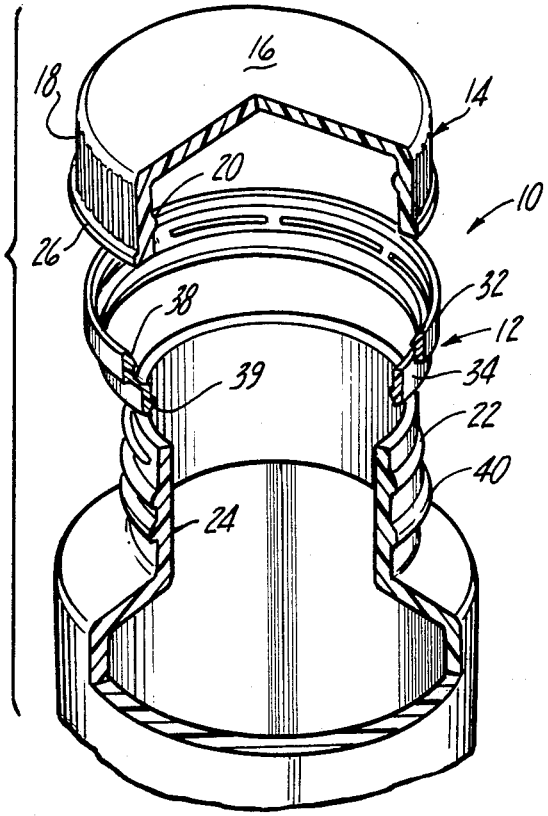
Fig-1
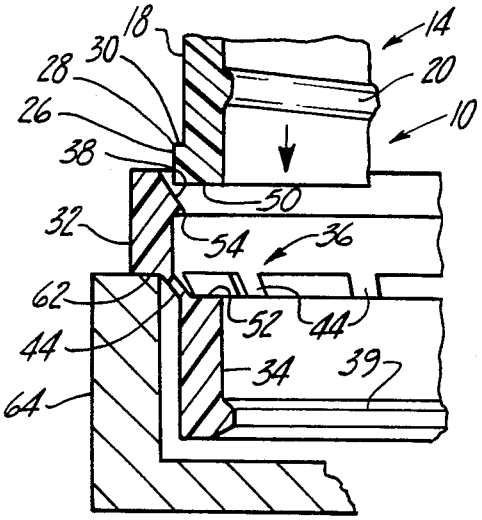
Fig-2
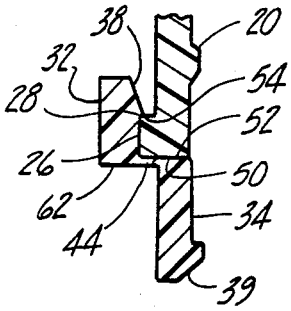
Fig-3
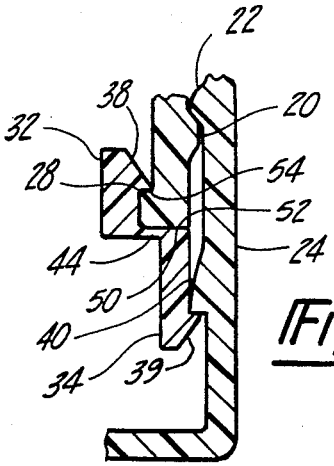
Fig-4
Fig-5
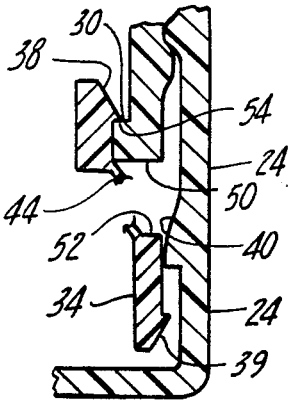

TAMPER INDICATING BAND FOR THREADED CAP

This invention relates to a tamper indicating closure, and, more particularly to a band which can be applied to a standard threaded cap to provide tamper indicating to the container package on which the cap is installed.

There are a considerable number of closures for containers which give an indication that the container has been initially opened or tampering has occurred. Such closures usually involve elaborately molded one or multiple piece caps which frequently require a special container. The purpose in using such a closure is to insure prospective customers that the container package has remained closed in its originally filled condition prior to purchase.

It is an object of this invention to provide a band which can be applied to a standard threaded cap to add tamper indication to the closure package.

It is another object of this invention to provide such a band for a conventional screw cap which can be applied to a variety of containers of standard configuration.

It is a further object of this invention to provide such a tamper indicating band which can be preassembled to a conventional screw cap to produce a closure which can be stored until it is applied to a filled container.

It is still another object of this invention to provide a tamper indicating band which can be constructed with a variety of connecting means for attachment to the cap and to the container.

The foregoing objects of the invention and other advantages are embodied in a tamper indicating band which is molded separately from the cap and container. Because the band is molded separately, a different material can be used to provide a difference in color to highlight the tamper indication and to provide a different material characteristic.

The band is designed primarily to be applied over the skirt of a standard screw cap to utilize the conventional scuff band at the lower end of the cap skirt as a cap flange which cooperates with a flange on the band for a snap action connection. The band is constructed with a separate upper portion or ring which permits that use of an external or an internal flange for connection to a corresponding internal or external flange type member on the cap. A separate lower portion or ring likewise permits the use of an external or internal flange for cooperating engagement with an internal or external flange on the neck of the container. Preferably, the upper ring is constructed with a diameter larger than the cap skirt diameter and having an internal flange which snaps over and is retained by the cap scuff band. The lower ring has a smaller diameter than the upper ring and is preferably formed with an inwardly directed circumferential flange which engages a complementary flange on the neck of the container. The lower band flange snaps over and is retained by the container flange.

The upper and lower band portions or rings are joined by a frangible connection which must be fractured in order to remove the cap. This frangible connection is in the form of a web which can be continuous and in the form of a tear strip which must be removed before the cap is unthreaded from the container. The frangible connection more commonly can be in the form of a plurality of uniformly spaced webs which are fractured as the cap is unthreaded; the lower ring being retained on the container neck as continuing evidence of the initial opening of the package. The frangible webs are connected between the inner periphery of the upper ring and the outer periphery of the lower ring, generally converging from the upper ring to the lower ring. The upper ring can be larger with the lower ring smaller but overlapping to provide vertically extending webs therebetween. The difference in diameter between the upper and lower rings can permit horizontally extending frangible connecting webs therebetween. In all of these web orientations, the bottom of the cap skirt bears against the top of the lower ring to transmit a downward driving force as the cap is threaded onto the container to snap the lower ring flange over the container flange without damage to the frangible webs.

The inwardly directed flange on the upper ring can be in the form of a continuous bead with a sharp edge undercut to engage the sharp upper edge of the scuff band. The scuff band must be thick enough to present a sharp edge and cooperating surface which the upper ring bead snaps over and is retained thereagainst. The upper bead or flange can be segmented to present as few as four to eight uniformly spaced engagement flanges or it can be molded as a plurality of adjacent tabs which extend upwardly from the inner periphery of the upper band to be folded downward to receive the cap skirt, snapping over and being retained by the scuff band.

The inwardly directed flange on the lower ring can also take the form of a continuous bead which may be rounded for engagement with the container or bottle bead. The bead can also be segmented in a manner similar to the upper band bead. In order to minimize the frictional force required to move the lower ring flange over the container flange, the bead may be molded with an upper bias so that as it is forced downwardly over the container flange, the bead flexes inwardly and then returns to its molded position for retention under the container flange. This type of upwardly biased bead or flange can also be segmented forming a plurality of uniformly spaced upwardly biased retention tabs.

The method of assembling the band to the cap and container to produce a tamper indicating originally packaged closure-container involves the following steps:

1. Supporting the band at the bottom of the upper ring;
2. Pushing the cap into the upper ring as it is being supported to snap the upper ring bead over scuff band without damage to the frangible webs for retention by the coaction of the bead with the scuff band forming a two-piece closure; and
3. Threading the two-piece closure onto the container or bottle neck while maintaining the bottom of the cap skirt in contact with the top of the lower ring so that the lower band will snap over the bottle bead without damage to the frangible webs.

The presently preferred embodiments are illustrated in the accompanying drawing in which:

FIG. 1 is a perspective view partially in section illustrating the tamper indicating band of the invention in its relative position with a standard screw cap for assembly thereto to provide a two-piece closure and in relative position with a standard container for assembly to provide a tamper indicating package;

FIG. 2 is an enlarged fragmentary sectional view showing the band being supported at the bottom of its upper ring for assembly by pushing the cap into the band from the top; the frangible connection is shown as a plurality of webs converging downwardly from the inner periphery of the upper ring to the outer periphery of the lower ring;

FIG. 3 is a fragmentary sectional view similar to FIG. 2 showing the band assembled to the cap with the cap being held captive between the upper ring flange and the scuff band on the lower end of the cap skirt;

FIG. 4 is a fragmentary sectional view showing the tamper indicating band of the invention united with a screw cap as a two-piece closure, as the closure has been applied to a container with the lower ring flange of the band being retained by the container bead;

FIG. 5 is a partial sectional view similar to FIG. 4 showing fracture of the frangible webs and separation of the lower ring upon unthreading of the two-piece closure clearly showing the tamper indication;

Figure 6:
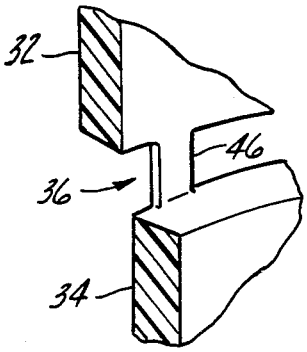
FIG. 6 is a partial perspective view of the band showing the frangible connection as a plurality of webs extending vertically downward from the inner periphery of the upper ring to the outer periphery of the lower ring.
Figure 9:
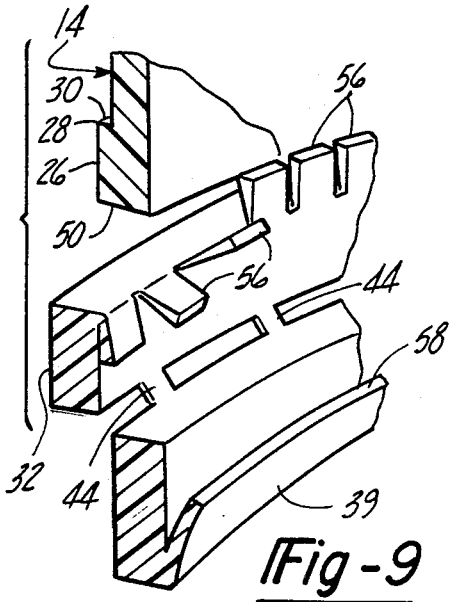
Figure 10:
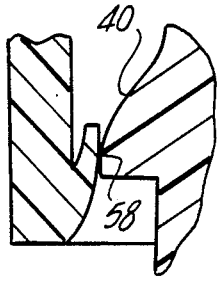
Figure 11:
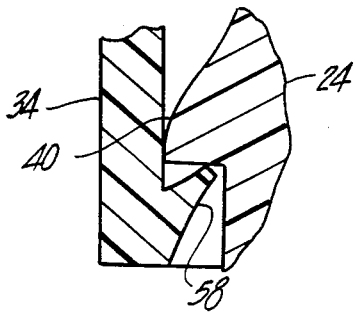
Figure 12:
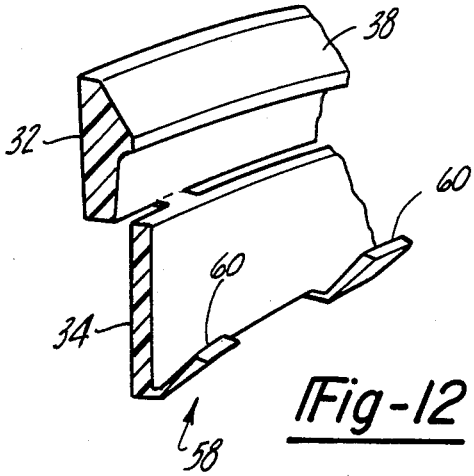

FIG. 9 is a partial perspective view similar to FIG. 6 showing the inwardly directed flange of the upper ring in the form of a segmented band molded with adjacent tabs pointed upwardly and showing how these tabs are folded or bent downwardly to form the undercut retention flange connection to the scuff band of the screw cap; this FIG. also shows the inwardly directed flange of the lower ring in the form of an upwardly biased continuous bead;

FIG. 10 is a partial sectional view showing the inwardly directed, upwardly biased lower ring bead as it is being flexed inwardly as the band is forced downwardly over the container bead;

FIG. 11 is a view similar to FIG. 10 showing the upwardly biased lower ring bead as it has returned to its molded position in engagement with the container bead; and FIG. 12 is a partial perspective view similar to FIG. 9 showing the inwardly directed lower band bead in the upwardly biased form but segmented to provide a plurality of equally spaced upwardly directed retention tabs.

A tamper indicating closure embodying the band of this invention is designated generally at 10 and is shown in an exploded relationship as the band 12 would be oriented for assembly to screw cap 14. Screw cap 14 is conventional in nature having a flat top 16 and a depending skirt 18 with internal threads 20 for engaging complementary threads 22 on the container neck 24 as shown in FIGS. 1 and 4. Cap 10 has a conventional scuff band 26 at the lower end of skirt 18 which as shown in FIGS. 4 and 5 has a sharp upper edge 28 and is thick enough to present a definite upper flange surface 30 for coaction with a flange on band 12.

Tamper indicating band 12 is formed with an upper portion or ring 32 and a lower portion or ring 34 which are joined together by a frangible connection 36.

Upper ring 32 has a larger diameter than cap skirt 18 and is provided with an inwardly directed flange 38 which coacts with scuff band 26 as a pair of snap rings retaining the band 12 on cap 14.

Lower ring 34 has a smaller diameter than upper ring 32 and has an inwardly directed flange 39 at its lower end which cooperates with complementary flange 40 on bottle neck 24. As closure 10 is applied to container neck 24, lower ring flange 39 snaps over and is retained by container flange 40.

Figure 7:
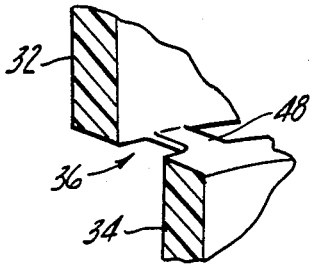
FIG. 7 is a partial perspective view similar to FIG. 6 showing the frangible connection as a plurality of horizontally disposed frangible webs joining the inner periphery of the upper ring with the outer periphery of the lower ring.
Figure 8:
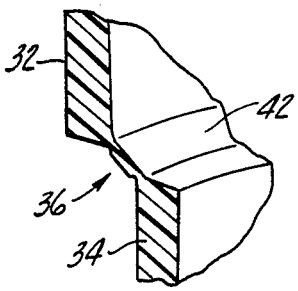
FIG. 8 is a partial perspective view similar to FIGS. 6 and 7 showing the frangible connection as a continuous web in the form of a tear strip which must be removed prior to unthreading the cap from the container.

The flangible connection 36 between upper ring 32 and lower ring 34 can take the form of a continuous web such as tear strip 42 shown in FIG. 8 which must be completely removed before the cap can be unthreaded from the container. More commonly, the frangible connection 36 takes the form of a plurality of uniformly spaced webs 44 which are connected to the inner periphery of upper ring 32 and the outer periphery of lower ring 34, and as shown in the embodiment depicted in FIGS. 1–5, webs 44 angle in or converge downwardly from upper ring 32 to lower ring 34. As shown in FIG. 6, the larger diameter upper ring 32 overlaps the smaller diameter lower ring 34 so that the equally spaced webs 46 extend vertically downward from the inside diameter of upper ring 32 to the outside diameter of lower ring 34. As shown in FIG. 7, the frangible web 48 can be horizontally extending between the inside diameter of upper ring 32 and the outside diameter of lower ring 34. In all of these web orientations, the bottom 50 of cap skirt 18 bears against the top 52 of lower ring 34 as the cap is threaded onto the container to snap the lower ring flange 39 on the lower end of lower ring 34 over the container bead 40 without damage to the frangible connection 36.

The inwardly directed flange 38 on the upper ring 32 can be in the form of a continuous bead with a sharp edge 54 which serves at the undercut to engage the sharp edge 28 on the top of scuff band 26. The upper bead can also be segmented into a number of equally spaced segments of various widths presenting as few as four to eight uniformly spaced engagment flanges. In another embodiment shown in FIG. 9, flange 38 is molded as a plurality of adjacent tabs 56 which extend upwardly from the inner periphery of the upper band and are folded downward as shown in the figure to receive the cap skirt, snapping over and being retained by scuff band 26.

The inwardly directed flange 39 on the lower ring 34 can also take the form of a continuous bead which may be rounded as shown in FIGS. 1 through 3 for engagement with the container bead 40. The lower band bead can also be segmented in a manner similar to the upper band bead. In order to minimize the frictional force required to move the lower ring bead or flange over the container flange, the bead may be molded with an upward bias as shown at 58 in FIGS. 9 through 11. This allows the bead to be flexed inwardly as it is forced downwardly over the container flange as shown in FIG. 10, and as the bead 58 passes the apex of the bottle bead 40, it flexes inwardly to return to its molded position for retention under the container flange as shown in FIG. 11. This type of upwardly biased bead or flange 58 can be segmented or formed as a plurality of individual flanges 60 as shown in FIG. 12.

In utilizing the tamper indicating band 12 of the invention, it is first assembled to the cap 14 by supporting the bottom edge 62 of the upper ring 32 on a ring support fixture 64 as shown in FIG. 2. This allows the cap 14 to be pushed vertically downward on its top 16 into upper ring 32 with the scuff band 26 passing over and snapping under inwardly directed flange 38. Support fixture 64 allows the lower ring 34 to hang freely so that the webs 44 are not damaged in this assembly process. This provides a two-piece tamper indicating closure which will remain together and can be stored prior to use. As closure 10 is applied to the container neck 24, the axial downward force created in threading will push the bottom 50 of skirt 18 against the top 52 of the lower ring 34 allowing the lower ring flange 39 to snap over the container bead 40 without damage to the frangible webs 44.

When any attempt is made to open the container by unthreading the cap 14, the lower ring 34 will remain in a fixed position vertically by the coaction of lower ring flange 38 and bottle flange 40 which will fracture the frangible webs 44, 46 or 48. This allows the lower ring 34 to slip down on the bottle neck 24 as shown in FIG. 5 to provide a continuing evidence of tampering or initial opening.

The embodiments of the invention in which an exclusive property or privilege is claimed are defined as follows:

1. A two-piece tamper indicating closure for an originally packaged threaded neck container, comprising, in combination: a cap having a top and a depending skirt with internal threads and an outwardly extending scuff band at the bottom thereof; a tamper indicating band having a large diameter upper ring and a smaller diameter lower ring and frangible web means connecting said rings; said upper ring having an inwardly projecting flange at its upper end for coacting with said scuff band, said flange snapping over and being retained by said scuff band, said upper ring also having a lower open cylindrical portion and said scuff band contacting said cylindrical portion to form said two-piece closure; said lower ring of smaller diameter than said upper ring having a top abutting the bottom of said cap skirt and an inwardly projecting flange for coaction with an outwardly projecting flange on the neck of said container, said lower ring flange snapping over and being retained by said container flange as said cap is screwed onto said container to close said original package without fracture of said frangible web means, said web means requiring fracture to remove said cap from said container, said fracture and retention of said lower ring on said container providing evidence of tempering or initial opening of said original package.

2. The tamper indicating closure of claim 1 wherein said upper ring flange is a continuous bead.

3. The tamper indicating closure of claim 2 further including a chamfered guide surface on said upper ring for assembly to said cap, said guide surface tapering inwardly from the top of said upper ring to the apex of said upper ring bead.

4. The tamper indicating closure of claim 1 wherein said upper ring flange is segmented.

5. The tamper indicating closure of claim 4 wherein said segmented flange is molded as a plurality of adjacent tabs extending upwardly from the upper inner periphery of said upper band and being folded downwardly to receive said cap skirt, snapping over and being retained by said scuff band.

6. The tamper indicating closure of claim 1 wherein said lower ring flange is a continuous bead.

7. The tamper indicating closure of claim 6 wherein said bead is rounded.

8. The tamper indicating closure of claim 6 wherein said bead is molded with an upper bias so that as it is forced downwardly over said container flange, the bead flexes inwardly and then returns to its molded position for retention under said container flange.

9. The tamper indicating closure of claim 8 wherein said bead is segmented forming a plurality of uniformly spaced upwardly biased retention tabs.

10. The tamper indicating closure of claim 1 wherein said frangible web means includes a plurality of equally spaced frangible webs which fracture upon unthreading of said cap as said lower ring is retained on said container by the coaction of said lower ring flange with said container flange.

11. The tamper indicating closure of claim 10 wherein said frangible webs converge downwardly between said upper and lower rings.

12. The tamper indicating closure of claim 10 wherein said frangible webs extend substantially vertically between the inner periphery of said upper band and the outer periphery of said lower band.

13. A two-piece tamper indicating closure for attachment to an orginally packaged container with a threaded neck comprising, in combination: a cap having a top and depending skirt with internal threads and an outwardly extending flange at the bottom thereof; a tamper indicating band having a larger diameter upper ring and a smaller diameter lower ring and a frangible connection between said upper and lower rings; said upper ring having an inwardly extending flange at its upper end and a lower open cylindrical portion below said flange, said upper ring snapping over said cap flange and being retained thereby and said cap flange contacting the cylindrical portion of said upper band; said lower ring having a top abutting the bottom of said cap skirt and means for engaging the neck of said container as said closure is threaded onto said container; the abutment of said cap skirt bottom with said lower ring top allowing application of said closure to said container without fracture of said frangible connection, but fracture of said frangible connection being necessary to remove said cap from said container, the fracture of said frangible connection and the retention of said lower ring on said container providing evidence of tampering or initial opening of said original packaged container.

14. The closure of claim 13 wherein said engagement means includes a circumferential flange extending radially inward from said lower ring for coaction with a complementary outwardly extending circumferential flange on the neck of said container, the abutment of the bottom of said cap skirt with the upper end of said lower band portion allowing said lower band flange to snap over said container flange without fracture of said frangible connection.

15. The closure of claim 13 wherein said larger diameter upper ring overlaps said smaller diameter lower ring and said frangible connection includes a plurality of circumferential, equally spaced webs extending vertically downward from the inside diameter of said upper ring to the outside diameter of said lower ring.

16. A band for attachment to a cap having a threaded skirt with a radially outward extending flange at its lower end providing a two-piece tamper indicating closure for an originally packaged container, said band comprising: an upper ring having a circumferential, radially extending flange which engages and snaps over and is retained by said cap skirt flange to form said two-piece closure; a lower ring of smaller diameter than said upper ring and having means for engaging the neck of said container as said closure is threaded onto said container; and a plurality of circumferential equally spaced webs extending horizontally between the inside diameter of said upper ring and the outside diameter of said lower ring requiring fracture to remove said cap from said container, said fracture providing evidence of tampering or initial opening of said original package.

17. A tamper indicating band for combination with a threaded cap having a scuff band at the lower edge of the cap skirt to provide a two-piece tamper indicating closure for an originally packaged threaded neck container, said band comprising: an upper ring having an inwardly projecting flange for coacting with said scuff band, said flange snapping over and being retained by said scuff band to form said two-piece closure; a lower ring of smaller diameter than said upper ring having an inwardly projecting flange for coaction with an outwardly projecting flange on the neck of said container, said lower ring flange snapping over and being retained by said container flange as said cap is screwed onto said container to close said original package; and a frangible web formed as a tear strip connecting the inner periphery of said upper ring and the outer periphery of said lower ring, said tear strip requiring fracture by manual force to permit unthreading of said cap from said container, said fracture and removal of said tear strip and the retention of said lower ring on said container neck providing evidence of tampering or initial opening of said original package.

18. A tamper indicating band for combination with a threaded cap having a scuff band at the lower edge of the cap skirt to provide a two-piece tamper indicating closure for an originally packaged threaded neck container, said band comprising: a upper ring having an inwardly projecting flange for coacting with said scuff band, said flange snapping over and being retained by said scuff band to form said two-piece closure; a lower ring of smaller diameter than said upper ring having an inwardly projecting flange for coaction with an outwardly projecting flange on the neck of said container, said lower ring flange snapping over and being retained by said container flange as said cap is screwed onto said container to close said original package; and frangible web means including a plurality of equally spaced, substantially horizontally extending frangible webs connecting the inner periphery of said upper ring and the outer periphery of said lower ring, said webs fracturing upon unthreading of said cap, said lower ring being retained on said container by the coaction of the lower ring flange with said container flange and providing evidence of tampering or initial opening of said original package.

19. The method of assembling a standard screw cap having a scuff band at the lower edge of the cap skirt to a bottle having a threaded neck and a bottle bead below said threads with an interposed tamper indicating band, said band having an upper ring of a larger diameter than said skirt and having an inwardly projecting bead and a lower ring having a diameter smaller than said upper ring and an inwardly projecting bead, said rings being joined by a plurality of equally spaced frangible webs connected between the inner periphery of said upper ring and the outer periphery of said lower ring, said method comprising the steps of: supporting said upper ring along its lower edge; pushing said cap into said upper ring as it is being supported to snap the upper ring bead over said scuff band without damage to said frangible webs for retention by the coaction of said bead and scuff band forming a two-piece closure; and threading said two-piece closure onto said bottle while maintaining the bottom of said cap skirt in contact with the top of said lower ring so that said lower band bead will snap over said bottle bead without damage to said frangible webs.

* * * * *